US008231449B2

(12) United States Patent
Martineck, Sr.

(10) Patent No.: US 8,231,449 B2
(45) **Date of Patent: *Jul. 31, 2012**

(54) INSTANT-WIN TICKET LOTTERY GAME

(75) Inventor: Jeffrey D. Martineck, Sr., Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 282 days.

This patent is subject to a terminal disclaimer.

(21) Appl. No.: 12/647,785

(22) Filed: Dec. 28, 2009

(65) Prior Publication Data

US 2010/0167805 A1 Jul. 1, 2010

Related U.S. Application Data

(60) Provisional application No. 61/141,171, filed on Dec. 29, 2008.

(51) Int. Cl.
*A63F 9/24* (2006.01)
*A63F 13/00* (2006.01)

(52) U.S. Cl. ..... 463/17; 463/16; 463/18; 463/19

(58) Field of Classification Search ..... 273/138.1, 273/139; 463/16–20
See application file for complete search history.

(56) References Cited

U.S. PATENT DOCUMENTS

| | | | | |
|---|---|---|---|---|
| 6,241,246 | B1 | 6/2001 | Guttin et al. | |
| 6,676,126 | B1 | 1/2004 | Walker et al. | |
| 2002/0065124 | A1 * | 5/2002 | Ainsworth | 463/20 |
| 2003/0178767 | A1 * | 9/2003 | Miller et al. | 273/139 |

* cited by examiner

*Primary Examiner* — Peter DungBa Vo
*Assistant Examiner* — Jasson Yoo
(74) *Attorney, Agent, or Firm* — Dority & Manning, P.A.

(57) ABSTRACT

A method and system for implementing an instant-win lottery game includes receiving a player's wager and selection of a game at a point-of-sale (POS) lottery location. The player receives a lottery ticket corresponding to the selected game, with the lottery ticket including a unique identification code that dictates the outcome of the game. The player accesses the lottery authority system via a wireless internet enabled mobile device to display and play and instant-win game to reveal the outcome of the lottery ticket.

14 Claims, 7 Drawing Sheets

INSTANT-WIN TICKET LOTTERY GAME

PRIORITY CLAIM

The present application claims priority to U.S. Provisional Application Ser. No. 61/141,171, filed Dec. 29, 2008.

FIELD OF THE INVENTION

The present invention generally relates to a lottery game and associated methodology, and more particularly to a unique instant ticket lottery game.

BACKGROUND

"Scratch-off" or "instant-win" lottery tickets have enjoyed immense popularity in the lottery industry for decades. These games offer distinct advantages to the lottery authorities, and are attractive to a broad spectrum of players. However, in order to sustain the public's interest in the instant games, new and different types of games and innovations are being constantly developed by the lottery industry. For example, it is desirable to provide new and innovate games that not only provide the opportunity for a player to win a prize, but also provide a variety of ways of winning the prize, which adds to the entertainment value of the lottery ticket and interest in the game.

Instant-win lottery games based on random generation of play symbols arranged in a designated winning pattern or order are known. For example, U.S. Pat. Application Pub. No. 2003/0178767 describes various embodiments of an instant-win lottery game wherein game tickets have a play area containing rows and columns of individual play spaces, with play symbols assigned to each of the play spaces. The play spaces are connected by a plurality of lines provided in the play area, with each line connecting at least two of the play spaces. A prize is awarded if at least one of the lines connects at least two play symbols of a preselected designation. For example, a winning line may connect three of the same type of symbols. A scratch-off layer is provided over the play area and is removed by the player to determine whether or not the ticket is a winner. The underlying pattern of lines is printed on the scratch-off layer and, typically, the lines will not vary. The location of the underlying play symbols determines whether or not the ticket is a winning ticket.

In another variation, U.S. Pat. No. 6,241,246 describes a lottery ticket with a having a game area with a grid of target letters arranged so that at least some of the letters form target words. A set of game words is covered by a scratch-off layer. Upon removing the layer, a player matches the target words with the game words to determine whether or not the ticket is a winner.

In still a different game, U.S. Pat. No. 6,676,126 describes an instant-win game wherein players have discretion in navigating across a play area by selection of play elements connected by lines to define a path across the play area. The play elements are covered by a scratch-off layer and symbols in the play elements determine whether or not the player has chosen a winning path.

The present invention relates to an instant-win lottery game ticket and related methodology that utilizes a unique variation of randomized line segments in a player area to provide an entertainment aspect not possible with conventional instant-win lottery tickets.

SUMMARY

Objects and advantages of the invention will be set forth in the following description, or may be obvious from the description, or may be learned through practice of the invention. It is intended that the invention include modifications and variations to the system and method embodiments described herein.

In a particular embodiment, an instant-win lottery game system is provided that includes a plurality of instant-win lottery tickets, with each ticket having a play area with a plurality of play spaces arranged in defined pattern. The play spaces may have any desired shape or configuration, such as squares, circles, ovals, and the like. Also, the play spaces may be arranged in a pattern whereby the play spaces are connected, or share a common side or aspect with at least one other space. For example, the play spaces may be defined by a grid of squares or rectangles arranged in column and row format. In an alternate embodiment, the play spaces may be separate and distinct from each other.

Play symbols of any desired type, depending for example on the game theme, are depicted in a plurality of the play spaces. A respective symbol may be provided in each play space, or only in select ones of the play spaces. As described further herein, the play symbols dictate whether or not the particular lottery ticket is a winner.

A plurality of line segments are also depicted in the play area, with each of the line segments connecting at least two of the play spaces. The line segments have a placement and orientation in the play area that is randomly generated for each of the lottery tickets. A defined percentage of the play spaces in the play area that is less than all of the play spaces are connected to at least one other play space by the randomly generated line segments. For example, the game may be designed to require about 40% (or any other %) of the play spaces, or a % range of the play spaces, in the pattern to be connected in order to achieve a desired probability of winning. This defined number of play spaces may be connected by any random number and pattern of line segments such that different lottery tickets in same game have the same percentage of connected play spaces but with different patterns of randomly generated line segments.

A "line segment" is understood herein to be a segment having a first end in one play space, and an opposite end in a different play space. The line segments may have any angular orientation within the pattern of play spaces. For example, the line segments may be vertical, horizontal, slanted, and so forth. The line segments may be straight, curved, serpentine, and so forth. Adjacent line segments may have ends that share a common play space.

A prize award section is defined on each lottery ticket that defines possible prize awards as a function of a number or pattern of the play symbols in said play spaces that are connected by said line segments. For example, a prize may be awarded for a defined number of the same type of play symbols connected by the line segments, or some other defined configuration of play symbols connected by the line segments.

A scratch-off layer is provided over at least a portion of the play area and covers the randomly placed line segments such that at least one unknown variable to the player prior to removal of the scratch-off layer is the randomly generated pattern of line segments. The scratch-off layer may cover the entire play area in a particular embodiment. This may be desired in that certain players find entertainment value in removing the scratch-off layer. In an alternative embodiment, the scratch-off layer is only provided to the extent necessary to cover the random pattern of line segments so as to minimize the removal process for other types of players.

Because at least the pattern of line segments is randomly generated for each lottery ticket, the play symbols assigned to the plays spaces may be a "constant" or uniform between the tickets of the same game. In other words, the same play symbols may appear in the same play spaces for all of the tickets. In this embodiment, the results of the game are determined solely as a function of the random generation of the line segments. In an alternate embodiment, the type, placement, or any other characteristic of the play symbols may also be randomized between the tickets such that the outcome of the game is determined as a function of the random line segments and random play symbols between different tickets.

With still another unique embodiment, replica play symbols, or any other indicia, may be depicted on the scratch-off layer that correspond to or otherwise identify the underlying play symbols such that the only unknown variable to the player prior to removal of the scratch-off layer is the randomly placed line segments. With this particular configuration, the player may be motivated to start the scratch-off process at the more valuable play symbols to determine if line segments are present at such play spaces. This may provide additional entertainment value to certain players. Alternatively, the scratch-off layer may also cover the play symbols without replica symbols or other indicia indicating the location of the symbols such that the unknown variables to the player prior to removal of the scratch-off layer is the randomly placed line segments and location of the play symbols.

The line segments may have varying characteristics between tickets of the same game, or between lines on individual respective tickets. For example, the line segments on a respective ticket may all have the same length, which may be different from the length of the line segments on another ticket. Alternatively, the lines segments may have a length that is randomly generated such that the line segments on a respective ticket may have different lengths.

The line segments may be connected in an end-to-end configuration to form a connected pattern of the line segments. In an alternative embodiment, the line segments are unconnected to each other.

The line segments may include one or more additional visual characteristic that is randomly generated and that is also a factor in determining the prize award. For example, the additional randomized visual characteristic may be the color or length of the respective line segments.

Configuration of the play symbols may vary widely within the scope and spirit of the invention. For example, the play symbols may be the same in the plurality of plays spaces, with the prize award being determined by on the number or pattern of play symbols connected by the line segments. Alternatively, play symbols may vary on a respective ticket, with the prize award being determined by the type of play symbols connected by the line segments. In a particularly unique embodiment, the play symbols comprise a first set of play symbols and a visually different set of second play symbols, with the prize award being a function of the type of play symbols in the play spaces connected by the line segments.

DETAILED DESCRIPTION

Figure 1:
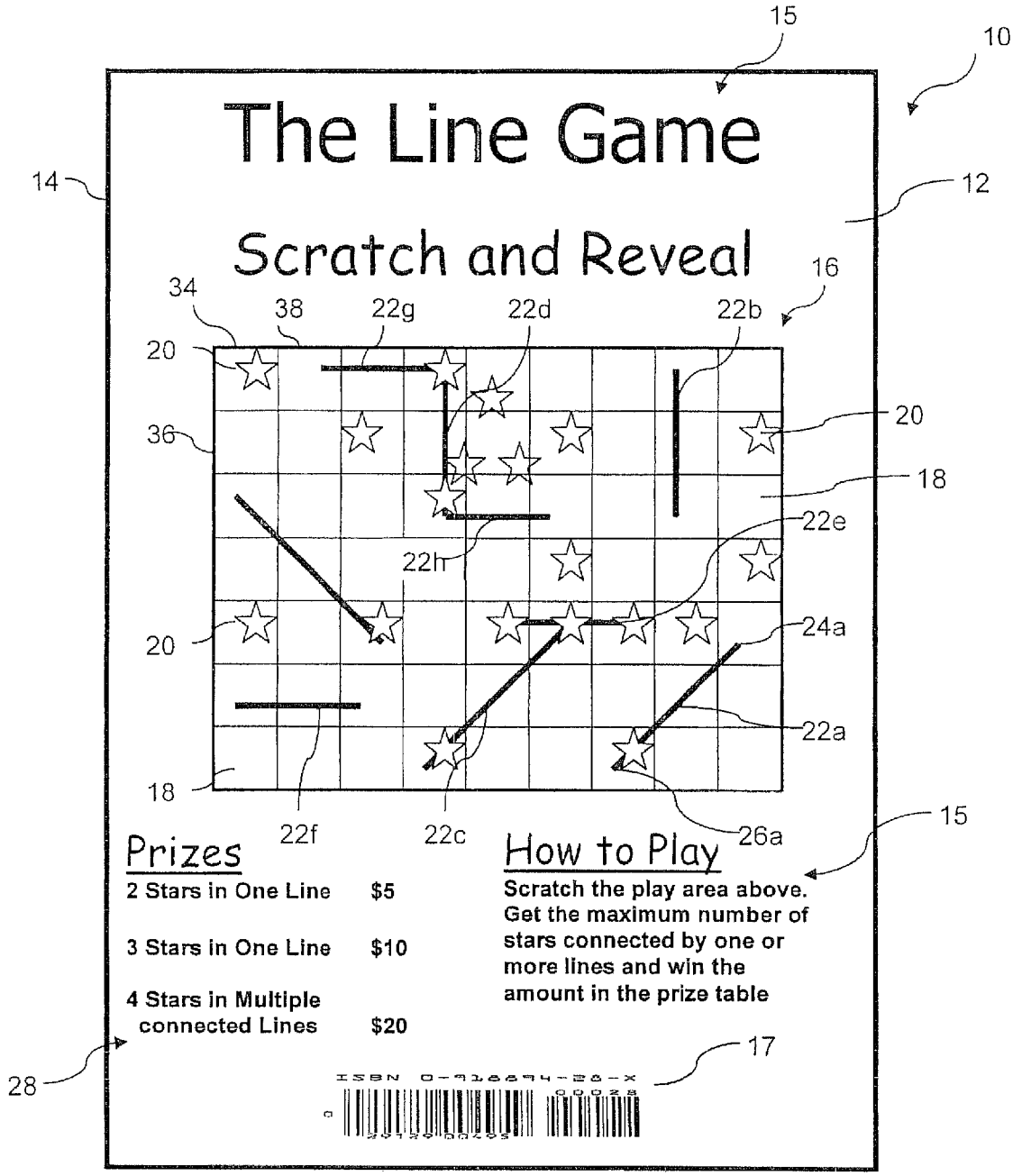
FIG. 1 is a front planar view of an embodiment of a lottery ticket in accordance with aspects of the invention having a randomized pattern of line segments.

Reference will now be made in detail to certain embodiments of the system and methodology in accordance with aspects of the invention, examples of which are illustrated in the drawings. Each embodiment is provided by way of explanation of the invention, and is not meant as a limitation of the invention. For example, features illustrated and described as part of one embodiment may be used with another embodiment to yield still a further embodiment. It is intended that the present invention include these and other modifications and variations as come within the scope of the appended claims and their equivalents.

Referring to the figures in general, various embodiments of an instant-win lottery game system 10 are depicted. Each system 10 includes a plurality of instant-win lottery tickets, with a single ticket 12 being illustrated in each of the FIGS. 1 through 7 for a particular embodiment. Referring to FIG. 1 in particular, each lottery ticket 12 is provided on any suitable substrate 14. The substrate 14 may be, for example, paperboard, card stock, paper, or any other suitable material used in the art for producing instant win lottery tickets. Each ticket 12 includes a play area 16 having a plurality of play spaces 18 arranged in a defined pattern. The play spaces 18 may have any desired shape or configuration, such as circles, ovals, and the like. In the illustrated embodiments, the play spaces 18 are depicted as square or rectangular, and are arranged in a grid pattern 34 having a plurality of columns 38 and rows 36. It should be readily appreciated that the pattern is not limited to a grid, but may be defined as any desired pattern of play spaces 18, such as a wheel, curved configuration, and the like. The play spaces 18 are generally arranged in any desired pattern such that the play spaces 18 are connected by a common side or other aspect with at least one other play space 18. In still an alternative embodiment not illustrated in the figures, the play spaces 18 may be defined separate and distinct from each other.

Any manner of play symbols 20 are provided in the play area 16 and populate a plurality of the play spaces 18. The play symbols 18 may have any desired shape, appearance, or other configuration that is in accordance with the theme or some other aspect of the lottery game. In the illustrated embodiment, the play symbols 20 are depicted as stars for illustrative purposes only. A respective play symbol 20 may be provided in each of the play spaces 18, or only in selected ones of the play spaces, as illustrated in the figures.

A plurality of line segments 22*a, b*, . . . are also depicted in the play area 16. Each of the line segments 22 connects at least two of the play spaces 18. Referring to line segment 22*a* in FIG. 1, each of the line segments includes a first end 24*a* and an opposite end 26*a*. A play space 18 in which one of the ends 24*a*, 26*a* resides is considered as connected by the line segment. For example, line segment 22*a* in FIG. 1 connects three distinct play spaces 18, with the play space 18 in which the end 26*a* is located containing a play symbol 20.

The pattern of line segments 22 have a placement and orientation in the play area 16 that is randomly generated for each of the lottery tickets 12 in an individual game. A defined percentage of the play spaces in the play area that is less than all of the play spaces 18 are connected to at least one other play space 18 by the randomly generated line segments 22. For example, referring to FIG. 1, the grid 34 contains nine columns 38 and seven rows 36 for a total of sixty-three play spaces 18. Twenty-three of these play spaces 18 are connected to at least one other play space by one of the line segments 22. The overall game may be designed to require this number, or a certain percentage or percentage range, of the play spaces in the pattern or grid 34 to be connected by the randomly oriented and placed line segments 22 to achieve a desired probability of winning. The defined number of play spaces 18 may be connected by any random number and pattern of line segments 22 such that different lottery tickets 12 in the same game have the same percentage of connected play spaces 18, but with different patterns and number of randomly generated line segments. For example, one ticket 12 may have nine distinct line segments, as illustrated in FIG. 1 that connect the required the percentage or number of play spaces 18, while a different ticket may have more than nine line segments 22, or less than line segments 22 that connect the same number of play spaces 18 depending on the length and orientation of the line segments 22.

The line segments 22 may have any angular orientation within the pattern of play spaces 18. For example, the line segments 22 may be vertical, horizontal, slanted, and so forth. Although depicted as straight line segments in the figures, it should be appreciated that the line segments 22 may be curved, serpentine, and so forth. Adjacent line segments 22 may have ends that share a common play space, such as the line segments 22*d* and 22*g* in FIG. 1.

The lottery tickets 12 may have any desired game theme, appearance, and so forth, that is provided by any manner of indicia 15 printed on the ticket. For example, the tickets 12 may have a sports theme, entertainment theme, casino-game theme, and so forth. The indicia 15 may also provide instructions as to how to play the game, as illustrated in the embodiments in the figures.

Each ticket 12 desirably includes a prize award section 28 that defines possible prize awards as a function of a number or pattern of the play symbols 20 in the play area 16 that are connected by the randomly generated pattern of line segments 22. For example, referring to FIG. 1, the prize award section 28 defines that two stars in one line is awarded $5. Three stars in one line is awarded $10. Four stars in multiple connected lines is awarded $20. Still referring to FIG. 1, it is readily appreciated that line segment 22*c* contains two stars and thus is worth $5. Line segment 22*e* contains three stars and is worth $10. Line segment 22*d* also connects two stars and is worth $5. Thus, the particular ticket illustrated in FIG. 1 is worth a total of $20 in prize awards.

Each ticket 12 may also include any manner of security or verification mark, such as the bar code 17 illustrated on the tickets. Any such mark or bar code 17 may be used for various purposes, including ticket authentication, verification, accounting, and so forth. It should be readily appreciated that any configuration of conventional authentication, verification, and other security or accounting features may be incorporated with any ticket 12 in accordance with the present invention.

Figure 3:
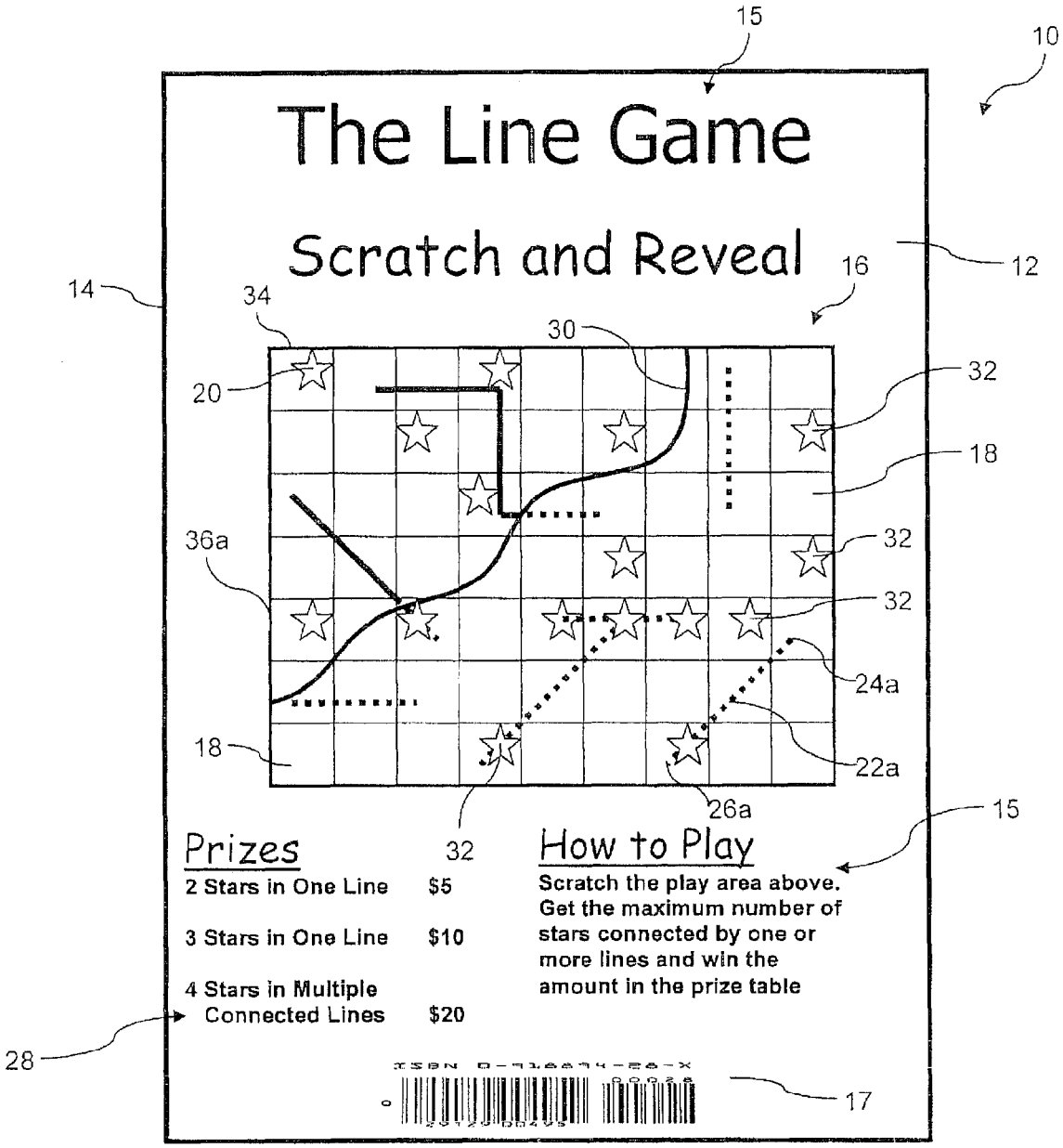
FIG. 3 is a front planar view of an embodiment of a lottery ticket having replica play symbols printed on the scratch-off layer.

Referring to FIG. 3, a scratch-off layer 30 is provided over at least a portion of the play area 16 and at least covers the randomly placed line segments 22. In this manner, at least one unknown variable to the player prior to removal of the scratch-off layer 30 is the randomly generated pattern of line segments 22. The scratch-off layer 30 may cover the entire play area 16 in a particular embodiment. Certain players derive increased entertainment value in removing a maximum amount of the scratch-off layer 30 in a given play area on a scratch-off lottery ticket. The embodiment of FIG. 3 will appeal to this type of player. In an alternative embodiment, the scratch-off layer 30 may only be provided to the extent necessary to actually cover or hide the random pattern of line segments so as to minimize the amount of scratch-off material 30 that must be removed to determine whether or not the ticket is a winning ticket. This embodiment will have appeal to another type of player.

The scratch-off layer 30 may be provided by any conventional scratch-off material that is well known in the art of scratch-off lottery tickets. The material 30 is typically an opaque latex layer that is easily removed by the player scraping their fingernail or other object to reveal the underlying indicia. A detailed description of the configuration and use of scratch-off layers 30 is not necessary for an appreciation of the present invention.

The tickets 12 in FIGS. 1, 2, and 4 through 7 depict the tickets after the scratch-off material 30 has been removed.

As mentioned, at least the pattern of line segments 22 is randomly generated for each lottery ticket 12 in a particular game. The play symbols 20 that are assigned to all or less than all of the play spaces 18 may be a "constant" or uniform between the tickets of the same game. For example, referring to the tickets in FIGS. 5 and 6, the play symbols 20 are provided in a uniform defined pattern in every other of the play spaces 18. With this particular configuration, a player is aware of the pattern of play symbols 20 in the play spaces 18 for all tickets 12 in the game, and the results of the game are thus determined solely as a function of the random generation of the line segments 22. In an alternative embodiment, the type, placement, or any other characteristic of the play symbols 20 may also be randomized between tickets 12 of the same game such that the outcome of the game is also determined as a function of the randomization of the play symbols between different tickets 12. For example, the random pattern of play symbols 20 in FIG. 1 is different than the uniform distribution of play symbols 20 in the embodiment of FIGS. 5 and 6. An additional randomized variable in the game may provide the game designers with increased flexibility on establishing a desired payout for the game, while maximizing the entertainment value provided to the players.

Referring to the embodiment of FIG. 3, replica play symbols may be over-printed on the scratch-off layer 30, with such replica symbols 32 corresponding to the position of the underlying play symbols 20. The term "replica play symbol" is used herein to include any manner of indicia that identifies the underlying play symbol. With this configuration, the player is aware of the location of all of the underlying symbols 20, and the only unknown variable to the player prior to removal of the scratch-off layer 30 is the randomly placed line segments 22. With this particular configuration, the player may be motivated to start the scratch-off process at the more valuable play symbols (or grouping of play symbols) 32 on the scratch-off layer 30 to determine if there are any underlying line segments 22 that connect such play symbols 20. For example, referring to the embodiment of FIG. 3, the player is presented with replica play symbols 32 in row 36*a* and, thus, is aware that this particular row contains six play symbols 20. The player is thus more likely to start the scratch-off process at or around row 36*a* to determine if any of the symbols 20 are connected by a respective line segment.

Figure 4:
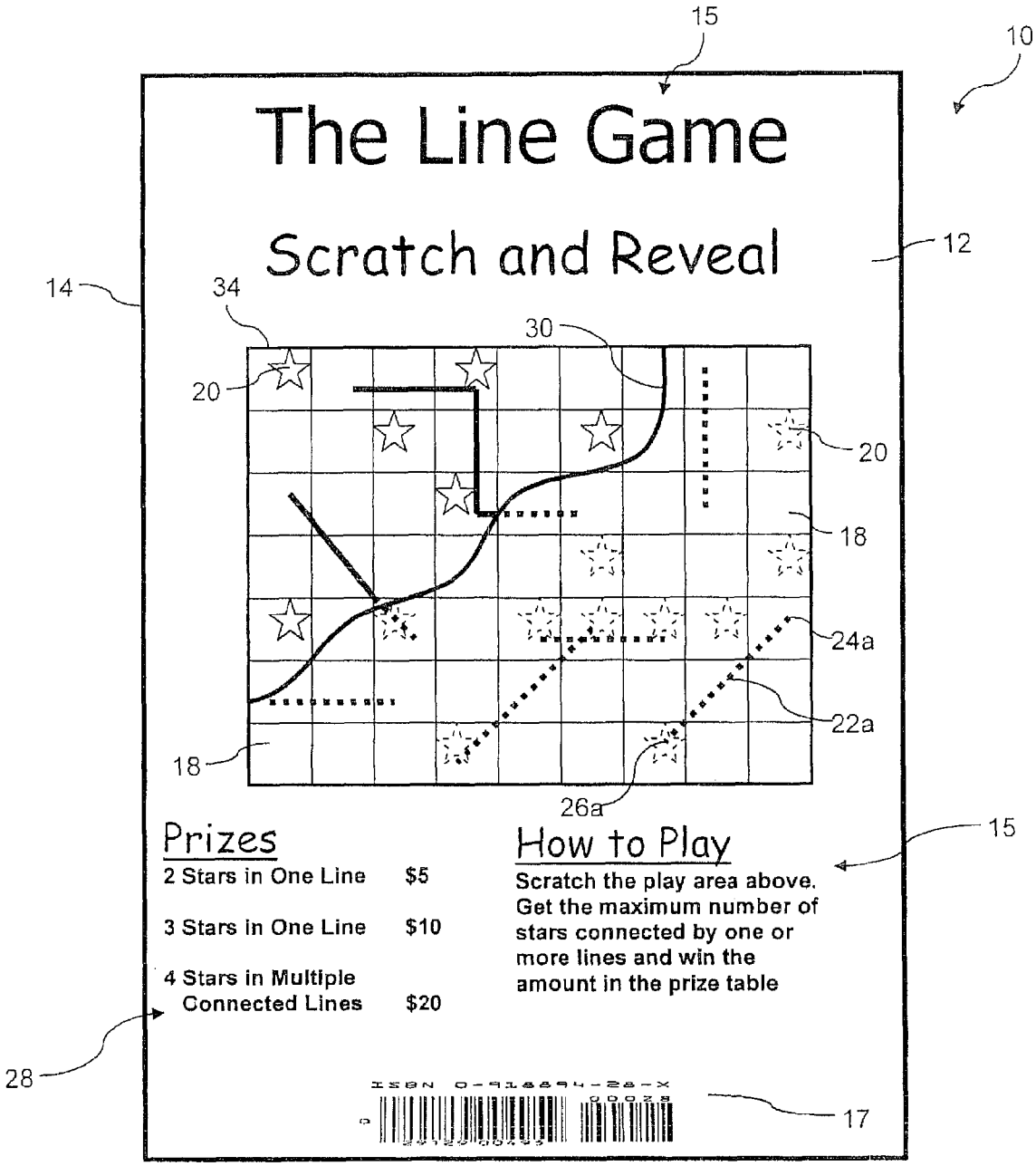
FIG. 4 is a front planar view of an embodiment of a lottery ticket having a scratch-off layer that covers the random pattern of line segments and random placement of the play symbols in the play spaces.

In an alternative embodiment illustrated for example in FIG. 4, the scratch-off layer 30 may also cover all or a portion of the underlying play symbols 20. In other words, the replica play symbols 32 are absent from the scratch-off layer such that the unknown variables to the player prior to removal of the scratch-off layer 30 is the randomly placed line segments and location of the underlying play symbols 20. With the particular embodiment illustrated in FIG. 4, any manner of indicia may be over-printed on the scratch-off layer 30 in the play area 16. It may be desired that the grid or pattern of play spaces 18 is overprinted on the scratch-off layer 30, without revealing the location of the underlying symbols 20 or line segments 22.

It should be appreciated that, in various embodiments, the line segments 22 may have varying characteristics between tickets of the same game, or between lines on individual respective tickets. For example, referring to FIG. 1, each of the line segments 22 has a length so as to connect three play spaces 18. This characteristic (length) may be constant for all of the tickets 12 in the game. In an alternative embodiment, it may be that all of the line segments 22 on an individual ticket 12 have the same length, but that different tickets in the same game may have a different uniform length. For example, an additional ticket in the same game as the ticket illustrated in FIG. 1 may have line segments 22 with a length of four play spaces, but with less line segments than the ticket of FIG. 1.

Figure 2:
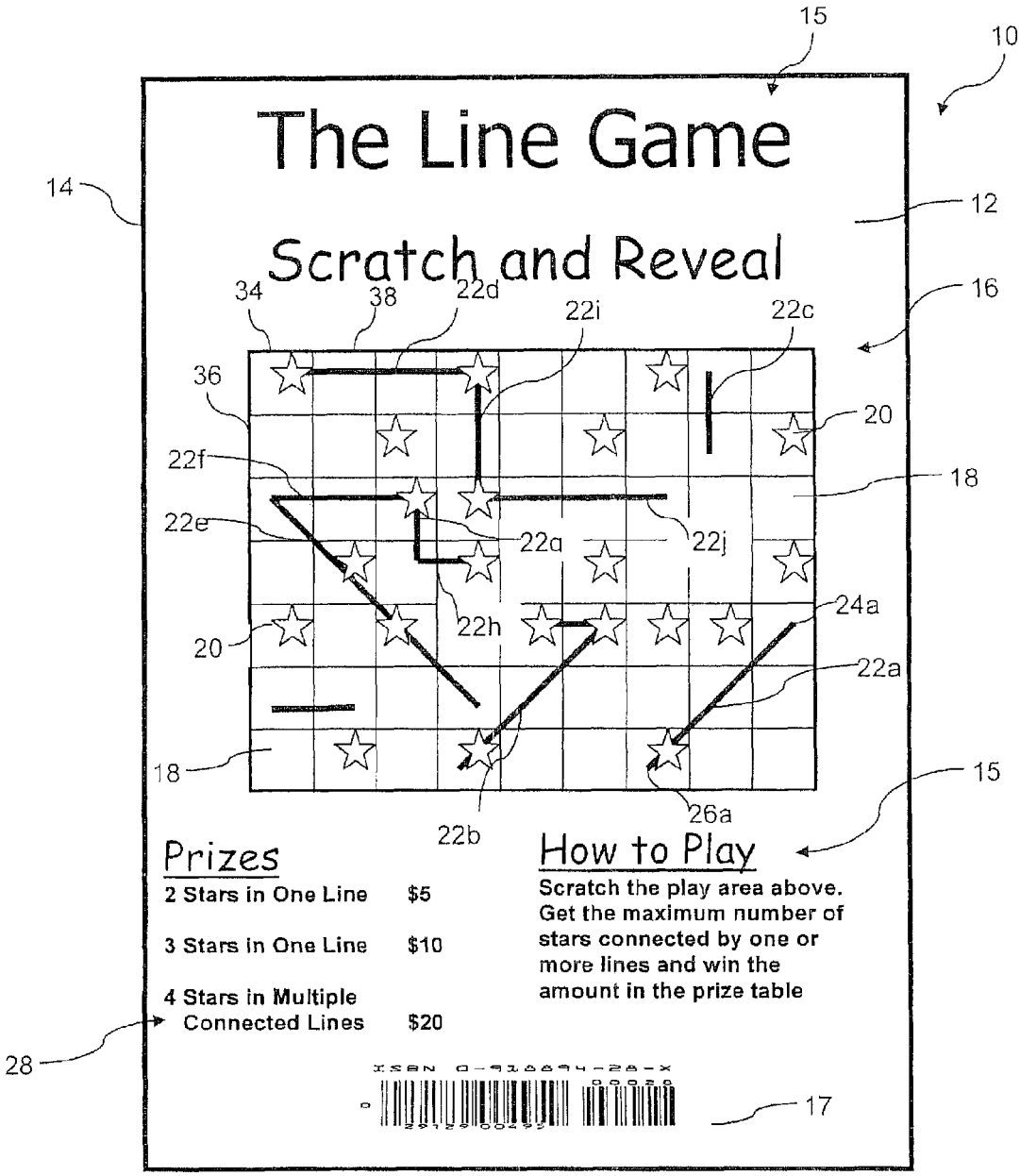
FIG. 2 is a front planar view of an alternative lottery ticket embodiment having a different pattern of randomized line segments.

In still a different embodiment as illustrated in FIG. 2, the plurality of line segments 22 may have a length that is randomly generated for an individual ticket 12 such that the line segments on a respective ticket 12 may have different lengths. For example, in FIG. 2, the line segment 22*a* has a length of three play spaces. The line segment 22*c* has a length of two play spaces. The line segment 22*j* has a length of four play spaces, as well as the line segment 22*e*.

Referring to FIGS. 1 and 2 in general, the individual line segments 22 may be connected in an end-to-end configuration to form a connected pattern of line segments. For example, in FIG. 1, the line segments 22*g*, 22*d*, and 22*h*, form a connected pattern of individual line segments. In the embodiment of FIG. 2, the line segments 22*e*, 22*f*, 22*g*, and 22*h* form a connected pattern of multiple lines that contains four stars. Thus, in this particular game, this connected pattern of multiple line segments has an award value of $20, as referenced in the prize award section 28.

Figure 5:
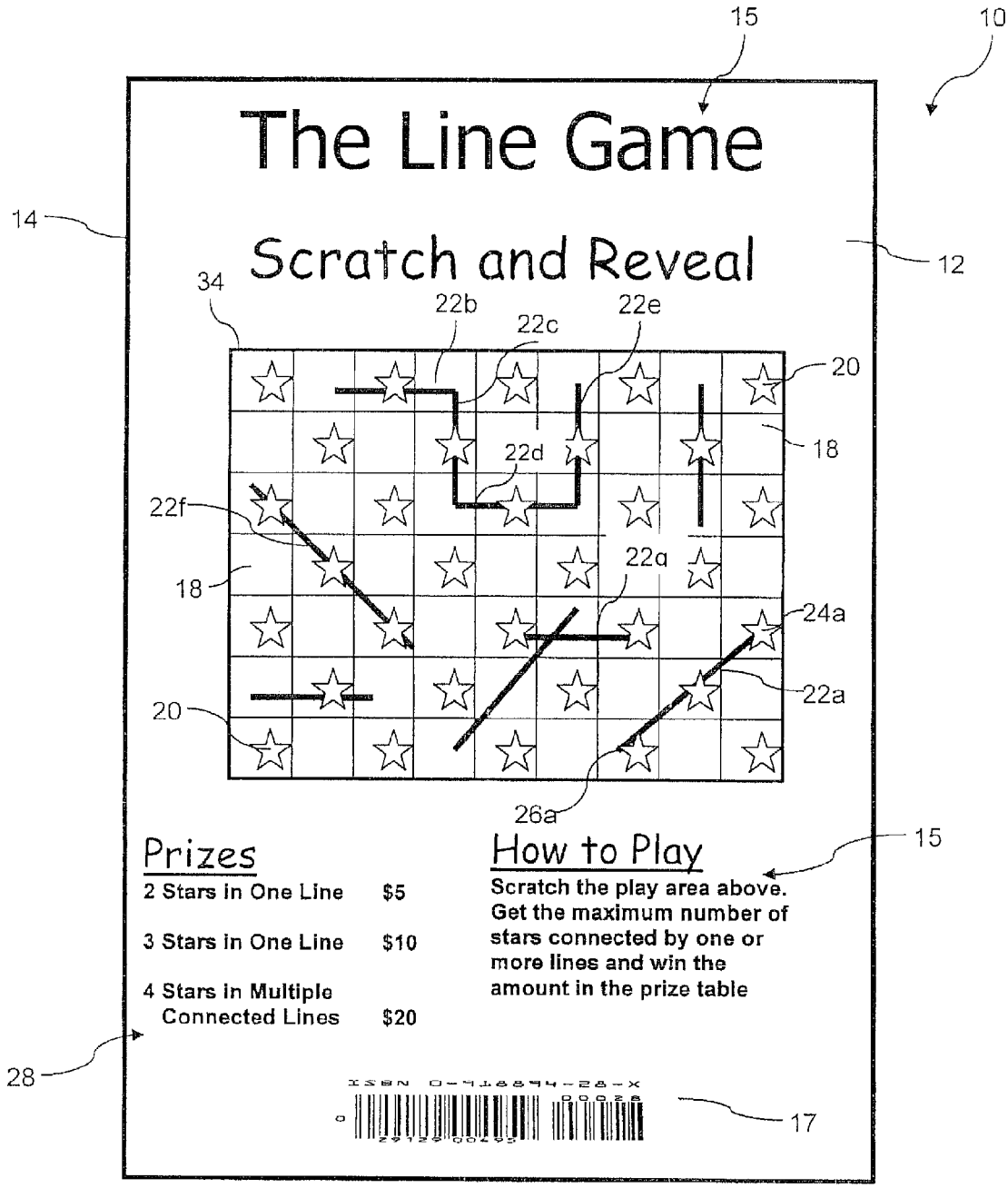
FIG. 5 is a front planar view of an embodiment of a lottery ticket wherein the same play symbols are depicted in a defined pattern of the plurality of play spaces.
Figure 6:
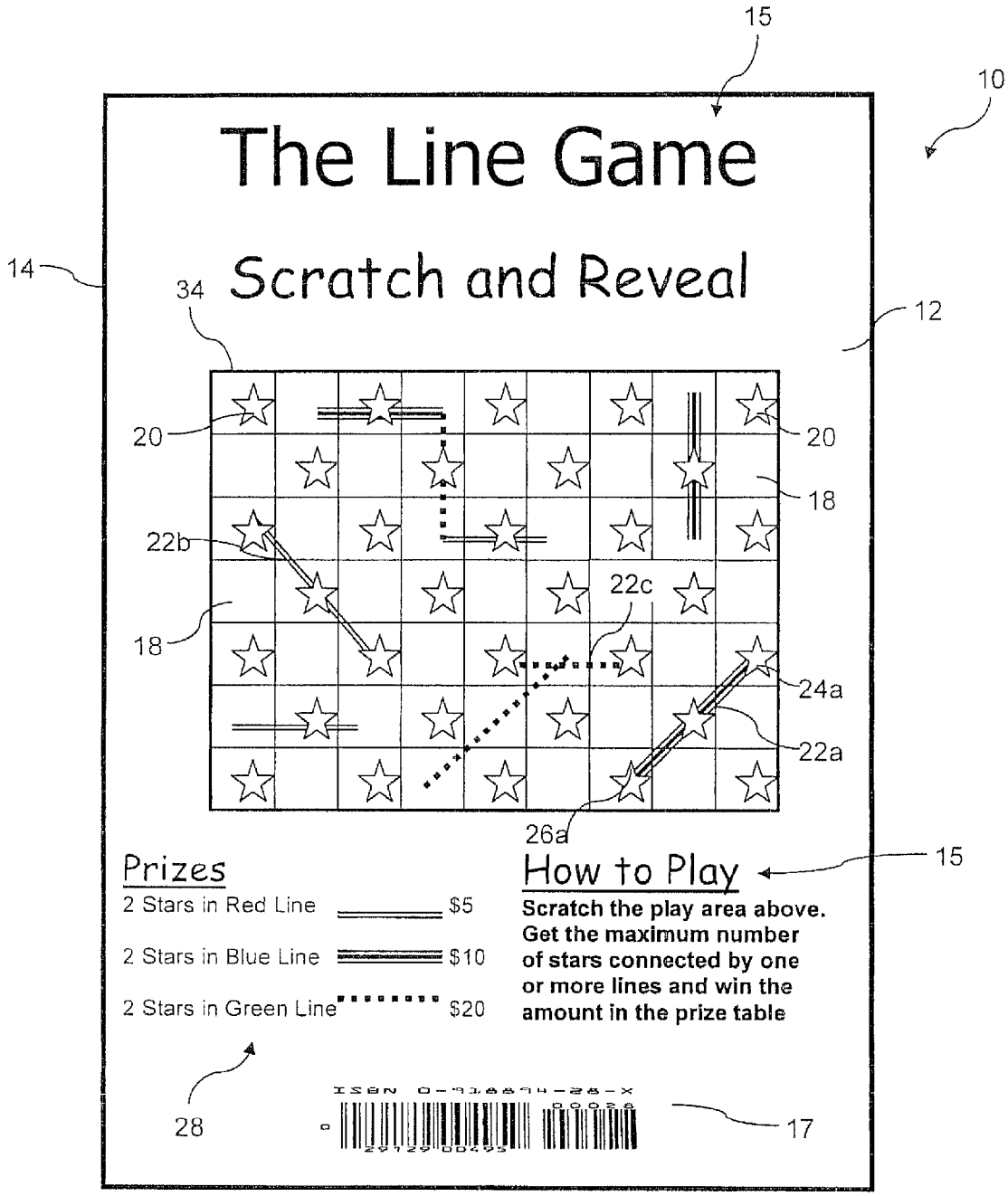
FIG. 6 is a front planar view of an embodiment of a lottery ticket wherein the same play symbols are depicted in a defined pattern of the plurality of play spaces, and the line segments include an additional randomized visual characteristic.

FIG. 5 illustrates an embodiment wherein a uniform pattern of play symbols 20 are arranged in the grid 34 in an alternating pattern. In this particular embodiment, each of the line segments 22 has a constant or common length of three play spaces. Thus, referring to the prize award section 28, line segment 22*a* connects three stars in one line and has a prize award value of $10. Line segment 22*f* also connects three stars and is worth an additional $10. Line segment 22*g* connects two stars and is worth $5. Line segments 22*b*, 22*c*, 22*d*, and 22*e* form a connected pattern of multiple line segments that connects four stars and is worth $20. Thus, the ticket 12 depicted in FIG. 5 has a prize award value of $45.

The line segments 22 in any of the games may include one or more additional visual characteristics that is also randomly generated, and that may also be a factor in determining the prize award. For example, in the embodiment illustrated in FIG. 6, the line segments 22 include the additional characteristic of color (that is depicted in the figure as a different style of line). In other words, the lines may have the same thickness or overall appearance, but be depicted in different colors on an actual game ticket. In an alternate embodiment, the lines may have a different overall visual style or appearance, such as the line segments 22 depicted in FIG. 6, with this style characteristic (e.g. multiple lines, dashed lines, and so forth) defining an additional randomized function of the line segments 22. Still referring to FIG. 6, it is appreciated from the prize table 28 that a green line is more valuable than a blue line, which is more valuable than a red line. In the particular ticket illustrated in FIG. 6, line segment 22*c* is a green line containing two stars, and thus has a prize award value of $20. Line segment 22*b* is a red line that includes at least two stars, and thus has a prize award value of $5. Line segment 22*a* is a blue line that includes at least two stars, and thus has a prize award value of $10.

Figure 7:
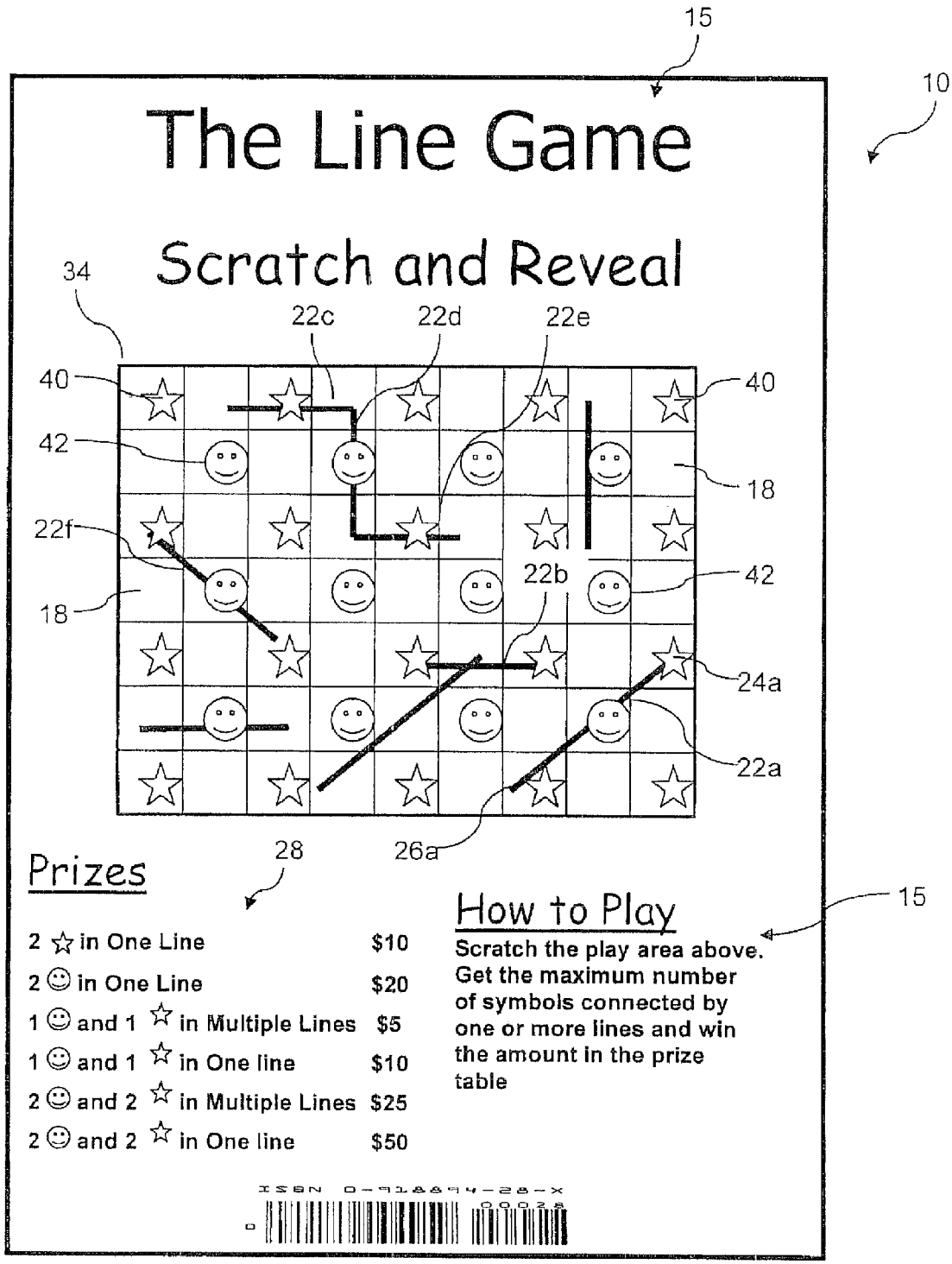
FIG. 7 is a front planar view of an embodiment of a lottery ticket wherein different sets of play symbols populate the plurality of play spaces, and determine the potential prize award for the ticket.

As discussed, configuration of the play symbols 20 may vary widely within the scope and spirit of the invention. For example, the play symbols may be the same in the plurality of play spaces 18, such as the stars 20 illustrated in the embodiments of FIGS. 1 through 6. With this configuration, the prize award is determined not as a function of a different type of play symbol 20, but by the number or pattern of play symbols 20 that are connected by the randomized line segments 22. In an alternative embodiment, the play symbols 20 may vary on a respective ticket, with certain play symbols 20 being more valuable than others and the prize award being determined as a function of the type of play symbols connected by the line segments 22. For example, in the embodiment of FIG. 7, a first set of play symbols 40 is depicted as stars. A second set of play symbols 42 is depicted on smiley-faces. The first and second sets 40, 42 of play symbols may be randomly generated and placed in the grid 34, or arranged in a uniform pattern as depicted in FIG. 7 and discussed above. Referring to the prize award section 28 in FIG. 7, it is readily appreciated that the type and number of play symbols in one or more connected lines determines the respective prize awards. For example, line segment 22*a* includes one smiley-face and two stars. This particular line segment 22*a* thus has two different prize award values of $10 for having two stars in one line and $10 for having one smiley-face and one star in one line. The same analysis applies for line segment 22*f*. Lines segment 22*b* contains two stars and thus has a prize award value of $10. Connected line segments 22*c*, 22*d*, and 22*e* include one smiley-face and two stars in multiple lines, and thus have a prize award value of $5.

It should be readily appreciated by those skilled in the art that various modifications and variations can be made to the embodiments illustrated and described herein without departing from the scope and spirit of the invention.

What is claimed is:

1. An instant-win lottery game system, comprising:

a plurality of instant-win lottery tickets, each of said tickets comprising a play area with a plurality of play spaces arranged in defined pattern;

play symbols depicted in a plurality of said play spaces but less than all of said play spaces;

a plurality of line segments depicted in said play area, with each said line segment connecting at least two said play spaces, said line segments having a placement and orientation in said play area that is randomly generated;

a defined percentage of said play spaces in said play area that is less than all of said play spaces being connected to at least one other said play space by said randomly generated line segments such that different said lottery tickets in said game system have the same percentage of connected play spaces but with different patterns of randomly generated line segments;

a prize award section on said lottery tickets that defines possible prize awards based on a number or pattern of said play symbols in said play spaces that are connected by said line segments without regard to distinctions between said play symbols; and a scratch-off layer is provided over at least a portion of said play area and covers said randomly placed line segments such that an unknown variable to the player prior to removal of said scratch-off layer is said randomly generated pattern of line segments.

2. The game system as in claim 1, wherein placement of said play symbols in said play spaces is randomly generated between different said lottery tickets.

3. The game system as in claim 1, wherein placement of said play symbols is the same for different said lottery tickets.

4. The game system as in claim 1, wherein replica play symbols are printed on said scratch-off layer that correspond to underlying play symbols such that the only unknown variable to the player prior to removal of said scratch-off layer is said randomly placed line segments.

5. The game system as in claim 1, wherein placement of said play symbols in said play spaces is randomly generated between different said lottery tickets, and wherein said scratch-off layer also covers said play symbols such that the unknown variables to the player prior to removal of said scratch-off layer is said randomly placed line segments and location of said play symbols.

6. The game system as in claim 1, wherein said lines segments have the same length.

7. The game system as in claim 1, wherein said line segments have a length that is also randomly generated.

8. The game system as in claim 1, wherein at least two of said line segments are connected end-to-end to form a connected pattern of said line segments.

9. The game system as in claim 1, wherein said line segments are unconnected to each other.

10. An instant-win lottery game system, comprising:

a plurality of instant-win lottery tickets, each of said tickets comprising a play area with a plurality of play spaces arranged in defined pattern;

play symbols depicted in a plurality of said play spaces;

a plurality of line segments depicted in said play area, with each said line segment connecting at least two said play spaces, said line segments having a placement and orientation in said play area that is randomly generated;

a defined percentage of said play spaces in said play area that is less than all of said play spaces being connected to at least one other said play space by said randomly generated line segments such that different said lottery tickets in said came system have the same percentage of connected play spaces but with different patterns of randomly generated line segments;

a prize award section on said lottery tickets that defines possible prize awards based on a number or pattern of said play symbols in said play spaces that are connected by said line segments;

a scratch-off layer provided over at least a portion of said play area that covers said randomly placed line segments such that an unknown variable to the player prior to removal of said scratch-off layer is said randomly generated pattern of line segments; and wherein said line segments comprise at least one additional visual characteristic that is randomly generated and that is a factor in determining said prize award in addition to the number or pattern of said play symbols connected by said line segments.

11. The game system as in claim 10, wherein said additional randomized visual characteristic is color.

12. The game system as in claim 10, wherein said additional randomized visual characteristic is format of said line segments without regard to length of said line segments.

13. The game system as in claim 1, wherein said play spaces are arranged in grid of rows and columns, each of said line segments having a length that is less than the number of play spaces in said rows and columns.

14. The game system as in claim 1, wherein said play symbols in said plurality of spaces are all visually the same.

* * * * *